US005783549A

United States Patent [19]

Gopalkrishnan et al.

[11] Patent Number: 5,783,549

[45] Date of Patent: Jul. 21, 1998

[54] POLYCARBOXYLATE POLYMERS FOR RETARDING THE GELATION OF SODIUM CARBONATE SLURRIES

[75] Inventors: Sridhar Gopalkrishnan, Woodhaven; Kathleen M. Guiney, Wyandotte; John V. Sherman, Allen Park, all of Mich.

[73] Assignee: BASF Corporation, Mount Olive, N.J.

[21] Appl. No.: 680,192

[22] Filed: Jul. 15, 1996

[51] Int. Cl.[6] ..... C11D 3/37

[52] U.S. Cl. ..... 510/337; 510/360; 510/361; 510/418; 510/434; 510/435; 510/476; 510/509

[58] Field of Search ..... 510/337, 360, 510/361, 418, 434, 435, 476, 509

[56] References Cited

U.S. PATENT DOCUMENTS

| | | | |
|---|---|---|---|
| 4,311,606 | 1/1982 | Kaeser | 252/135 |
| 4,362,640 | 12/1982 | Schrieber | 252/135 |
| 4,368,134 | 1/1983 | Kaeser | 252/526 |
| 4,820,441 | 4/1989 | Evans | 252/174.18 |
| 4,900,466 | 2/1990 | Atkinson et al. | 252/174.14 |
| 5,534,183 | 7/1996 | Gopalkrishnan et al. | 510/434 |
| 5,536,440 | 7/1996 | Gopalkrishnan et al. | 510/417 |
| 5,595,968 | 1/1997 | Gopalkrishnan et al. | 510/418 |
| 5,618,782 | 4/1997 | Gopalkrishnan et al. | 510/418 |

*Primary Examiner*—Mukund J. Shah
*Assistant Examiner*—Bruck Kifle
*Attorney, Agent, or Firm*—Joanne P. Will

[57] ABSTRACT

The present invention relates to a method for retarding the gelation of aqueous sodium carbonate slurries comprising adding to said aqueous sodium carbonate slurry a polycarboxylate polymer having the following structure:

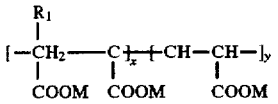

9 Claims, No Drawings

POLYCARBOXYLATE POLYMERS FOR RETARDING THE GELATION OF SODIUM CARBONATE SLURRIES

FIELD OF THE INVENTION

This invention relates to the use of polycarboxylate polymers as gelation retarders for sodium carbonate slurries

BACKGROUND OF THE INVENTION

In the detergent industry, powder detergents are typically built with sodium carbonate as a key ingredient, and the use of sodium carbonate as a key component in powder detergent has particularly increased in light of recent legislation which have virtually eliminated the use of phosphates in household laundry detergents. In a typical manufacturing process for powdered laundry detergents, ingredients such as anionic surfactants and builders such as sodium carbonate are mixed along with water to form a slurry in the crutcher. The typical concentration of such a slurry is around 50–55% solids, because higher concentrations are always desirable as it improves the efficiency of the crutching operation resulting in significant cost savings to the detergent manufacturer.

However, when slurry compositions essentially comprise inorganic salts such as sodium carbonate, particularly where sodium carbonate is a major component (50% by weight or more), they typically form a hard mass within a few hours when stored at ambient temperatures (below 30C.). The hardened mass resembles a cement block and in some ways the mechanism of setting of a sodium carbonate slurry is similar to that of Portland Cement, i.e. via hydration. This limitation restricts the utility of such slurries and severely curtails the "window of operation" for such slurries. The prior art has attempted to solve the problem of working with sodium carbonate slurries. Specifically, U.S. Pat. No. 4,368,134 teaches the use of additives such as citric acid and magnesium sulfate salts which inhibit the gelation of crutcher slurries. U.S. Pat. No. 4,362,640, discloses a method of reducing the viscosity of carbonate based crutcher slurries during the addition of aqueous sodium silicate by adding CO2 with the silicate solution. U.S. Pat. No. 4,311,606 discloses a method of reducing the viscosity of carbonate based crutcher slurries by the addition of sodium sesquicarbonate along with citric acid. U.S. Pat. No. 4,900,466 discloses sodium carbonate slurries comprising carboxylate polymers useful in crystal growth modification to improve surfactant absorption during detergent manufacture. Also, the carboxylate copolymers of U.S. Pat. No. 4,900,466 are of 1000–250,000 molecular weight. U.S. Pat. No. 4,820,441 also discloses carbonate slurries comprising carboxylate polymers useful in crystal growth modification to improve surfactant absorption during detergent manufacture. The carboxylate polymers of U.S. Pat. No. 4, 820,441 are of 1000–300,000 molecular weight.

The prior art, however does not make any reference to the use of low molecular weight polycarboxylate polymers as retarders for the gelation of carbonate based slurries. Applicants have surprisingly discovered that the addition of low molecular weight acrylic acid/maleic acid copolymers to sodium carbonate slurries substantially retards the gelation time of concentrated sodium carbonate slurries. Thus, said slurries can be stored for longer periods of time without gelling.

SUMMARY OF THE INVENTION

The present invention relates to a polycarboxylate polymer useful in retarding the gelation of aqueous sodium carbonate slurries having the following structure:

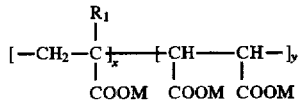

where x and y are integers representing weight percentages of monomer units, and x and y cannot be 0, and M is an alkali metal such as sodium, or hydrogen, and said monomer units are in random order;

$R_1$=H or $CH_3$;

preferably x is from 20–60% by weight of the total polymer ,more preferably x can be 20–50% by weight of the total polymer, and most preferably x can be 40% by weight of the total polymer. Preferably, y is from 40–80% by weight of the total polymer, more preferably y is 50–80% by weight of the total polymer , and most preferably y is 60% of the total polymer.

The molecular weight of the polycarboxylate polymer is preferably 700–3000, more preferably 1000–3000, and most preferably 1000–1500.

The present invention further relates to a method for retarding the gelation of aqueous sodium carbonate slurries comprising adding to said aqueous sodium carbonate slurry a polycarboxylate polymer having the following structure:

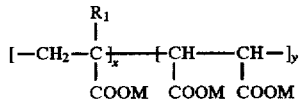

where x and y are integers representing the weight percentages of unsaturated monomer units, and x and y cannot be 0, and M is an alkali metal such as sodium, or hydrogen, and the said unsaturated monomer units are in random order.

$R_1$=H or $CH_3$;

preferably x is from 20–60% by weight of the total polymer more preferably x can be 20–50% by weight of the total polymer, and most preferably x can be 40% by weight of the total polymer. Preferably, y is from 40–80% by weight of the total polymer, more preferably y is 50–80% by weight of the total polymer, and most preferably y is 60% of the total polymer.

The molecular weight of the polycarboxylate polymer is preferably 700–3000, more preferably 1000–2000, and most preferably 1000–1500.

DETAIL DESCRIPTION OF THE INVENTION

A polycarboxylate polymer useful in retarding the gelation of aqueous sodium carbonate slurries having the following structure:

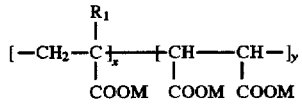

where x and y are integers are integers representing the weight percentages of monomer units and x and y cannot be zero, and M is an alkali metal such as sodium, or hydrogen and the monomer units are in random order;

$R_1$=H or $CH_3$;

preferably x is from 20–60% by weight of the total polymer, more preferably x can be 20–50% by weight of the total polymer, and most preferably x can be 40% by weight of the total polymer. Preferably, y is from 40–80% by weight of the total polymer, more preferably y is 50–80% by weight of the total polymer, and most preferably y is 60% of the total polymer.

The molecular weight of the polycarboxylate polymer is preferably 700–3000, more preferably 1000–2000, and most preferably 1000–1500.

The present invention further relates to a method for retarding the gelation of aqueous sodium carbonate slurries comprising adding to said aqueous sodium carbonate slurry a polycarboxylate polymer having the following structure:

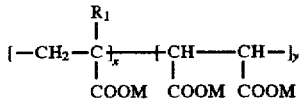

where x and y are integers representing the weight percentages of unsaturated monomer units, and x and y cannot be 0, and M is an alkali metal such as sodium, or hydrogen, and the said unsaturated monomer units are in random order.

$R_1$=H or $CH_3$;

preferably x is from 20–60% by weight of the total polymer, more preferably x can be 20–50% by weight of the total polymer, and most preferably x can be 40% by weight of the total polymer. Preferably, y is from 40–80% by weight of the total polymer, more preferably y is 50–80% by weight of the total polymer, and most preferably y is 60% of the total polymer.

The molecular weight of the polycarboxylate polymer is preferably 700–3000, more preferably 1000–2000, and most preferably 1000–1500.

Aqueous Sodium Carbonate Slurries

Aqueous sodium carbonate slurries are prepared by mixing 1 part sodium carbonate to 1 part water. Said slurry compositions of the present invention may optionally contain water-soluble, non-phosphate non-polymeric polycarboxylates. Examples of non-polymeric polycarboxylates are the sodium, potassium, lithium, ammonium and substituted ammonium salts of ethylenediametetraacetic acid, nitrilotriacetic acid, oxydisuccinic acid, mellitic acid, benzene polycarboxylic acids, citric acid, and methyl glycine diacetic acid ("MGDA"). Other optional ingredients include sodium and potassium carboxymethyloxymalonate, carboxymethyloxysuccinate, cis-cyclohexanehexacarboxylate, cis-cyclopentanetetracarboxylate, and phloroglucinol trisulfonate and polyacetyl carboxylates described in U.S. Pat. No. 4,144,226, issued Mar. 13, 1979 to Crutchfield, et al, and U.S. Pat. No. 4,246,495 issued Mar. 27, 1979 to Crutchfield, et al, both incorporated herein by reference. The slurry compositions of the present invention may optionally contain minor amounts of surfactants selected from non ionic, anionic, cationic, amphoteric and zwitterionic. Further, the slurry compositions of the present invention may optionally contain minor amounts of builders, such as phosphates, zeolites, sodium silicates may be used.

Polycarboxcylate Polymners

The polycarboxylate polymers, of the present invention, usefull in retarding the gelation of aqueous sodium carbonate slurries, have the following structure:

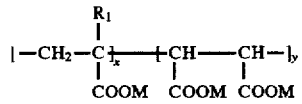

where x and y are integers representing the weight percentages of monomer units and x and y cannot be 0, and M is an alkali metal such as sodium, or hydrogen and said monomer units are in random order;

$R_1$=H or $CH_3$;

preferably, x is from 20–60% by weight of the total polymer ,more preferably x can be 20–50% by weight of the total polymer, and most preferably x can be 40% by weight of the total polymer. Preferably, y is from 40–80% by weight of the total polymer, more preferably y is 50–80% by weight of the total polymer , and most preferably y is 60% of the total polymer.

The molecular weight of the polycarboxylate polymer is preferably 700–3000, more preferably 1000–2000, and most preferably 1000–1500.

The monomers may be selected from the group consisting of acrylic acid, methacrylic acid, crotonic acid, itaconic acid, vinylacetic acid, methacylate esters, substituted methacylate esters, acrylamide, vinyl acetate, methyl vinylether and vinylsulphonate. Preferably, the monomer component in the formula shown above is acrylic acid.

The polycarboxylate copolymer of the present invention may be prepared by the skilled artisan according to the process below, in which acrylic acid is polymerized with maleic acid in the presence of an initiator, selected from the group including , but not limited to, azo initiators such as 2,2'- azobis isobutyroitrile and 2,2'-azobis (amidinopropane) dihydrochloride, hydroperoxides, persulfates, and redox initiator systems Other suitable initiator systems are discussed in the *Polymer Handbook*, published by John Wiley and Sons. Hydrogen peroxide is the preferred initiator. The following specific, non-limiting example is illustrative of the preparation process for the copolymer of the present invention.

Preparation of a Copolymer of Acrylic Acid with Maleic Acid (a polycarboxylate polymer of the present invention)

A 2L Flask is charged with 150.44 grams of water and pressure purged three times to 50 psig with nitrogen followed by venting to 1 psig 150.44 grams of maleic anhydride is added to the vessel followed by 238.67 g of a 50% solution of caustic soda. The solution is stirred for a period of 30 minutes. The pH of the solution is maintained between 6 and 7 by suitable adjustments with sodium hydroxide or maleic anhydride. The temperature of the solution is then raised to 228 F. followed by a continues nitrogen sparge. Acrylic acid (119.2 in 76.44 g of water) is charged linearly at such a rate that the addition is also complete in five hours. Simultaneously, 210.39 g of aqueous hydrogen peroxide initiator (35%) is charged linearly into the vessel such that the addition is also complete in five hours. When the acrylic acid and the hydrogen peroxide initiator feeds are complete, the lines are flushed with 10 g of water and post-polymerization is commenced at 228 F. for tow hours. The vessel is then vented to 0 psig and then cooled to 160 F. 44.34 g of a 50% sodium hydroxide solution is then charged into the vessel with continuous stirring for one hour. The temperature is not allowed to exceed 190 F. during this step.

After this step is completed, the temperature is raised to 217 F. to insure that all of the hydrogen peroxide has reacted. The resulting solution is then cooled, drained and evaluated for pH and % solids.

Preparation of the Carbonate Slurries

In crutcher slurry applications, the slurry can be formulated to also include, in addition to alkali metal carbonate, alkali metal silicate, alkali metal bicarbonate and zeolite. Such slurries are typically used to prepare household laundry powder detergents, wherein such a slurry is pumped through a spray tower and the resulting dried base beads are then sprayed with a nonionic liquid detergent. Alkali metal carbonate slurries, crutcher slurries of the type described above, have a tendency to gel and gelation of slurried poses a serious threat to the continuity of the operation. While there are many ways to retard gelation of such slurries, it has been found that the addition of a small amount of a copolymer of this invention significantly retards the gelation and in certain instances completely prevents gelation of alkali metal carbonate slurries.

The polycarboxylate copolymer of this invention will comprise about 0.01 to 5% by weight of the sodium carbonate in the slurry. Preferably, the copolymer of the invention will make up about 0.5 to 4.0%, even more preferably about 2% by weight of the sodium carbonate in the slurry. Unless otherwise stated, all weight percentages are based upon the weight of the total sodium carbonate in the slurry.

The following examples described in Table-1 will serve to demonstrate the efficacy of the copolymer according to various embodiments of the invention. In this table, the percentage of polymer is expressed by weight of the sodium carbonate in the slurry. The sodium carbonate slurry is prepared by mixing 1 part sodium carbonate to 1 part water.

The polymer is then added to the prepared slurry and the slurry is then stirred for 30 minutes. The slurry is then stored under ambient temperature (25 C.–30 C.). Observations are them made every 24 hours to determine if the slurry has set to a hardened mass. The relative efficacy of the polymers in retarding gelation is determined by the length of time it takes for the slurry to set to a hardened mass. These examples should not be construed as limiting the scope of the invention.

Table 1 illustrates the utility of the present invention. Not all polycarboxylate polymers are capable of retarding the gelation of sodium carbonate slurries. Specifically, the low molecular weight polycarboxylate polymer of the present invention is most effective in inhibiting the gelation of carbonate slurries over substantial periods of time. The present invention is clearly useful in preparing sodium carbonate slurries which can be stored until ready for use in manufacturing the final product.

TABLE 1

| # | Polymer | % | # of hours before the sodium carbonate slurry sets |
|---|---|---|---|
| 1 | None | 1 | 24 |
| 2 | Sokalan PA 75 (Polyacrylic acid, sodium salt, MW = 90,000) | 1 | 72 |
| 3 | Sokalan PA30C1 (Polyacrylic acid, sodium salt, MW = 8000) | 1 | 48 |

TABLE 1-continued

| # | Polymer | % | # of hours before the sodium carbonate slurry sets |
|---|---|---|---|
| 4 | Sokalan CP5 (Acrylic acid/Maleic acid copolymer, molecular weight (MW) = 70,000) | 1 | <24 |
| 5 | Sokalan CP10 (Modified Polyacrylic acid, MW = 4000) | 1 | 72 |
| 6 | Sokalan PM10 (Copolymer of maleic acid, sodium salt, MW = 1200) | 1 | 48 |
| 7 | Copolymer of the present invention. (acrylic/maleic copolymer, prepared using $H_2O_2$, MW = 1000) | 1 | Has not set in 8 months |

LEGEND TO TABLE 1

SOKALAN ® CP5 - Acrylic acid/Maleic acid copolymer, molecular weight (MW) = 70,000, product of BASF Corporation, Mt Olive, NJ.

SOKALAN ® PA30C1 - Polyacrylic acid, sodium salt, MW = 8000, product of BASF Corporation, Mt Olive, NJ.

SOKALAN ® PA75 - Polyacrylic acid, sodium salt, Mw = 90,000, product of BASF Corporation, Mt Olive, NJ.

SOKALAN ® CP10 - Modified Polyacrylic acid, MW = 4000, product of BASF Corporation, Mt Olive, NJ.

SOKALAN ® PM-10 - Copolymer of maleic acid, sodium salt, MW = 1200, product of BASF Corporation, Mt Olive, NJ.

The copolymer of the present invention is an acrylic/maleic copolymer prepared using hydrogen peroxide as preferred initiator with a final molecular weight of 1000.

The sodium carbonate used to make the slurry in Table-1 is FMC-100, a product of FMC Corporation.

While the invention has been described in each of its various embodiments, it is to be expected that certain modifications thereto may occur to those skilled in the are without departing from the true spirit and scope of the invention as set forth in the specifications and the accompanying claims.

We claim:

1. An aqueous sodium carbonate slurry comprising a polycarboxylate polymer having the following structure;

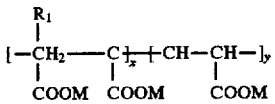

where x is 20–60% by weight of the total polycarboxylate polymer and y is 40–80% by weight of the total polycarboxylate polymer; $R_1$=H or $CH_3$; M is a alkali metal, and the molecular weight of said polycarboxylate polymer is from about 700–3000, wherein further, said polycarboxylate polymer is useful in retarding the gelation of said aqueous sodium carbonate slurry.

2. A slurry according to claim 1, wherein x is 20–50% by weight of the total polymer and y is 50–80% by weight of the total polymer.

3. A slurry according to claim 1, wherein x is 40% by weight of the total polymer and y is 60% by weight of the total polymer.

4. A slurry according to claim 1, wherein the molecular weight of said polycarboxylate polymer is 1000–1500.

5. An aqueous sodium carbonate slurry comprising a polycarboxylate polymer having the following structure

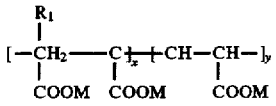

where x is 20–60% by weight of the total polycarboxylate polymer and y is 40–80% by weight of the total polycarboxylate polymer; $R_1$=H or $CH_3$; M is a alkali metal, and the molecular weight of said polycarboxylate polymer is from about 700–3000; further provided that said polycarboxylate polymer is prepared in the presence of a hydrogen peroxide initiator, wherein further, said polycarboxylate polymer is useful in retarding the gelation of said aqueous sodium carbonate slurry.

6. A method for retarding the gelation of aqueous sodium carbonate slurries comprising adding to said aqueous sodium carbonate slurry a polycarboxylate polymer having the following structure:

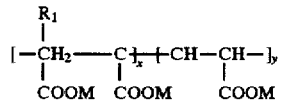

where x is 20–60% by weight of the total polycarboxylate polymer and y is 40–80% by weight of the total polycarboxylate polymer; $R_1$=H or $CH_3$; M is a alkali metal, and the molecular weight of said polycarboxylate polymer is from about 700–3000.

7. A method according to claim 6, wherein x is 20–50% by weight of the total polymer and y is 50–80% by weight of the total polymer.

8. A method according to claim 5, wherein x is 40% by weight of the total polymer and y is 60% by weight of the total polymer.

9. A method according to claim 5, wherein the molecular weight of said polycarboxylate polymer is 1000–1500.

* * * * *

UNITED STATES PATENT AND TRADEMARK OFFICE

CERTIFICATE OF CORRECTION

PATENT NO. : 5,783,549

DATED : July 21, 1998

INVENTOR(S) : Gopalkrishnan, et al

It is certified that error appears in the above-identified patent and that said Letters Patent is hereby corrected as shown below:

On the cover page, Abstract, please delete the formula:

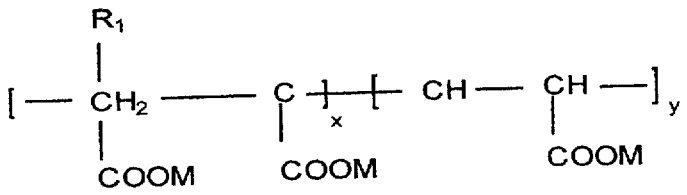

and replace it with:

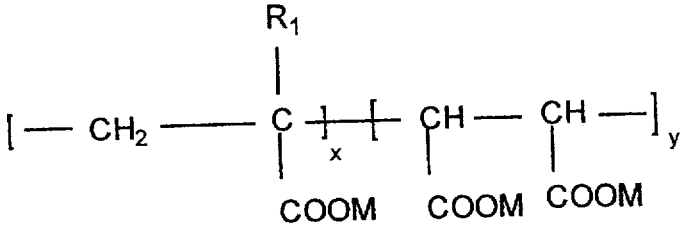

UNITED STATES PATENT AND TRADEMARK OFFICE

CERTIFICATE OF CORRECTION

PATENT NO. : 5,783,549

DATED : July 21, 1998

INVENTOR(S) : Gopalkrishnan, et al

It is certified that error appears in the above-identified patent and that said Letters Patent is hereby corrected as shown below:

In the Claims:

In Claim 1, please delete:

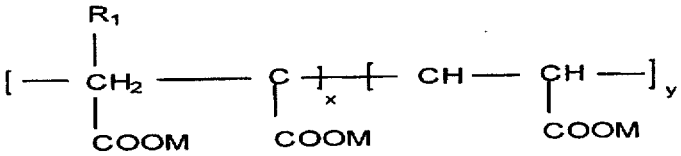

and insert in its place:

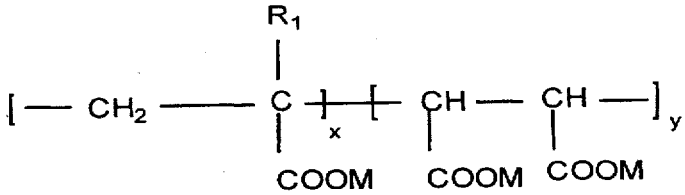

In Claim 5, please delete:

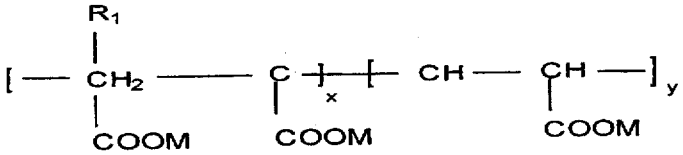

and insert in its place:

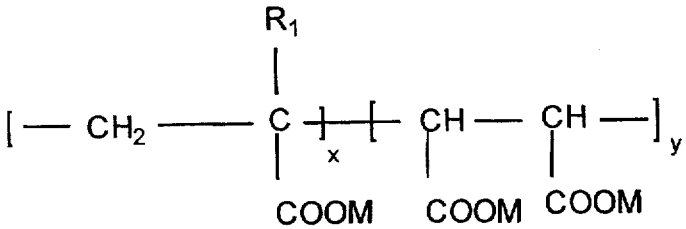

UNITED STATES PATENT AND TRADEMARK OFFICE

CERTIFICATE OF CORRECTION

PATENT NO. : 5,783,549

DATED : July 21, 1998

INVENTOR(S) : Gopalkrishnan, et al

It is certified that error appears in the above-identified patent and that said Letters Patent is hereby corrected as shown below:

In the Claims:

In Claim 6, please delete:

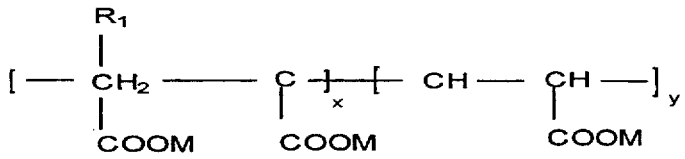

and insert in its place:

UNITED STATES PATENT AND TRADEMARK OFFICE

CERTIFICATE OF CORRECTION

PATENT NO. : 5,783,549

DATED : July 21, 1998

INVENTOR(S) : Gopalkrishnan, et al

It is certified that error appears in the above-identified patent and that said Letters Patent is hereby corrected as shown below:

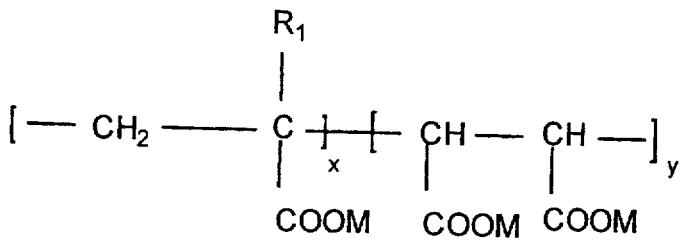

Signed and Sealed this

Second Day of March, 1999

*Attest:*

Q. TODD DICKINSON

*Attesting Officer*

*Acting Commissioner of Patents and Trademarks*